US006135548A

United States Patent [19]

McGuire

[11] Patent Number: 6,135,548

[45] Date of Patent: Oct. 24, 2000

[54] CHAIR-TABLE COMBINATION

[75] Inventor: Marc D. McGuire, Harrisburg, Pa.

[73] Assignee: M S Products, Inc., Cookeville, Tenn.

[21] Appl. No.: 09/264,300

[22] Filed: Mar. 8, 1999

[51] Int. Cl.[7] ..... A47B 83/02

[52] U.S. Cl. ..... 297/163; 297/173

[58] Field of Search ..... 297/173, 163, 297/135, 170

[56] References Cited

U.S. PATENT DOCUMENTS

| | | | |
|---|---|---|---|
| 633,399 | 9/1899 | Street et al. . | |
| 749,670 | 1/1904 | Gardner . | |
| 828,079 | 8/1906 | Williamson . | |
| 1,398,496 | 11/1921 | Saltalamachia | 297/163 |
| 2,330,476 | 9/1943 | Donchess | 155/43 |
| 3,220,765 | 11/1965 | Hoffmann | 297/124 |
| 4,767,159 | 8/1988 | Opsvik | 297/423 |
| 4,792,183 | 12/1988 | Townsend, III | 297/163 |
| 5,169,209 | 12/1992 | Beroth | 297/163 X |
| 5,275,465 | 1/1994 | Gulliver et al. | 297/173 |
| 5,490,710 | 2/1996 | Ninni | 211/184 |
| 5,588,697 | 12/1996 | Yoshida et al. | 297/173 |
| 5,857,740 | 1/1999 | Duboulet | 297/173 X |
| 5,927,799 | 7/1999 | Tornero | 297/173 X |
| 5,931,527 | 8/1999 | D'Onofrio et al. | 297/163 X |

*Primary Examiner*—Peter M. Cuomo
*Assistant Examiner*—Stephen Vu
*Attorney, Agent, or Firm*—Lucian Wayne Beavers; Waddey & Patterson

[57] ABSTRACT

The present invention relates to chairs and work stations. One embodiment of the present invention is for a chair comprising a base and a seat supported by the base, wherein the seat has a seat front and a seat back. The chair includes a backrest and a backrest support for supporting the backrest in a position relative to the seat which allows the seat to be utilized in a first and a second mode of operation. The first mode of operation includes an occupant sitting on the seat facing forward, and the second mode of operation includes an occupant sitting on the seat facing rearward. A stowable table is attached to the backrest. When in an upright position the stowable table extends in a substantially rearward direction. The stowable table may be stowed when not in use. A method of setting up and utilizing a portable work station is also described. The method includes utilizing a chair-table combination wherein the table is stowable. Particular embodiments of the invention are optimized for use as a manicurist's chair-table, and a portable laptop support.

28 Claims, 6 Drawing Sheets

CHAIR-TABLE COMBINATION

BACKGROUND OF THE INVENTION

The present invention relates generally to furniture. More particularly, this invention relates to furniture for a salon as well as office furniture. Mobile chairs and desks are common in the industry, however, easily portable work stations are not. Generally one must purchase a chair and a desk and move these separate items to an appropriate location. When the desk is not in use it is still taking up space. Rental space can be costly, thus, the desk is costing money simply by taking up space. This is particularly the case in beauty salons where the need for a manicurist desk may be intermittent. However, the need may be often enough to warrant providing clients with manicure service. Thus, a manicure station would be required. If the service is not provided, valuable revenue could be lost.

What is needed is an economical device which will allow a manicurist to sit facing a client, and a work surface to support a client's hands and allow the manicurist to work on the client's hands. When a manicuring job is not required it would be useful to place the work surface out of the way.

In the general office, or school environment, it is frequently useful to have a mobile desk with a chair. However when the desk is not needed one would prefer to have the extra space. It is also desirable to avoid the expense of separate stand alone desks which are awkward and cumbersome to move about, and which take up space. It is believed the present invention overcomes these failings in the prior art.

SUMMARY OF THE INVENTION

The present invention relates to furniture. More particularly the present invention relates to chairs and portable work stations. One embodiment of the invention is particularly well suited to the manicurist industry. Another embodiment is particularly well suited for use with portable laptop computers.

One embodiment of the present invention is for a chair comprising a base; and a seat supported by the base. The seat has a seat front and a seat back. The seat front and the seat back define a forward direction as referenced from the seat back toward the seat front, and a rearward direction as referenced from the seat front toward the seat back. The chair includes a backrest and backrest support means for supporting the backrest in a position relative to the seat which allows the seat to be utilized in a first mode of operation and in a second mode of operation. The first mode of operation includes an occupant sitting on the seat facing forward, and the second mode of operation includes an occupant sitting on the seat facing rearward. The backrest support means is supported by the base and connected to the backrest. The chair also includes a stowable table and table support means for supporting the stowable table in a stowed position and in an upright position. In the upright position the stowable table extends rearward from a position near the backrest in a generally horizontal orientation. In the stowed position the stowable table extends downward in a substantially vertical orientation. The table support means is connected to the backrest in a stowable table.

The invention also includes a mobile work station comprising a base and a seat having a front and a back which defines corresponding forward and backward directions, respectively. The mobile work station includes a vertical support member having an upper portion, a lower portion, and a horizontal support member attached to the upper support member. The vertical support member is attached to the base near the seat back to position the horizontal support member at a lower back support height. The horizontal support member is also positioned to define a first leg opening between the horizontal support member and the seat wherein the first leg opening is sufficiently large to accommodate a leg of the user sitting on the seat facing backward, wherein the lower back support height corresponds to a height at which the horizontal support member is positioned to provide lower back support for a user seated on the seat facing forward. The work station also includes a work surface having a first edge, a second edge and a top surface, the first edge being attached to the horizontal support member and extending from the horizontal support member.

Another embodiment of the invention includes aligning the vertical support member with a central portion of the seat back and orienting the generally planar surface at an optimal work angle relative a horizontal plane. The user then sits on the seat, straddling the vertical support member. Here straddling is intended to imply that one of the user's legs is to the left side of a plane through the vertical support and that the other of the user's legs is to the right side of the plane. Use of the term straddling is not intended to imply that the user has wrapped her legs about the vertical support, although this is an option is some embodiments. This allows the user to use the work surface while sitting on the chair in a second mode of operation. The user may then fold, or stow, the table by lowering it to a lower position and sitting on the seat in the first mode of operation.

Thus a mobile work station is provided at a lower cost.

Accordingly, one object of the present invention is to provide a chair-table combination wherein the table folds down out of the way.

Another object of the present invention is to provide a manicurist's stool including a table for supporting the forearms of a client receiving a manicure. It is a further object of the invention to provide a manicurist's stool wherein the table folds down out of the way.

It is an object of the present invention to provide a portable work station to facilitate use of laptops. It is a further object of the present invention to provide this portable work station with a stowable table top which swings into a stowed position.

Another object of the present invention is to provide a portable work station for chemical application is a salon setting. This embodiment would provide the client a comfortable seat on which to sit while providing the technician a table top on which to rest her chemicals and tools while servicing the client.

It is a further object of the present invention to provide a portable work station wherein the user may readily adjust the work surface. It is a further object of the present invention to provide work piece support means on the work surface.

Other objects and advantages of the present invention will be apparent to those of skill in the art from the teaching disclosed herein.

DESCRIPTION OF THE PREFERRED EMBODIMENTS

Figure 1:
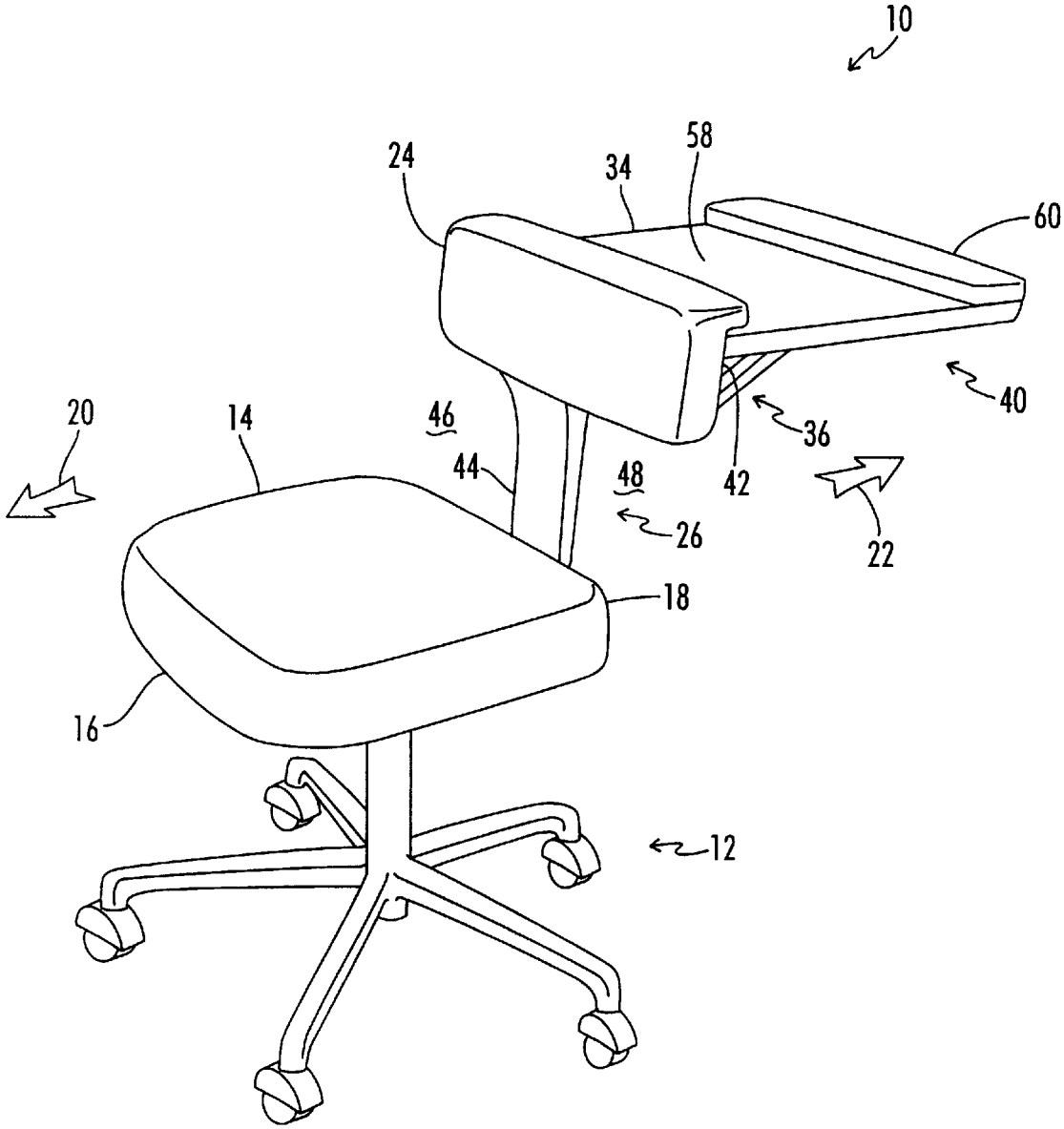
FIG. 1 shows a prospective view of the present invention with the stowable table in an upright position.

This invention relates to office and salon furniture. More particularly the present invention relates to portable work stations and chairs. The present invention will be more clearly understood by reference to the attached drawings, wherein like reference numerals and characters refer to like parts, and the claims.

Figure 2:
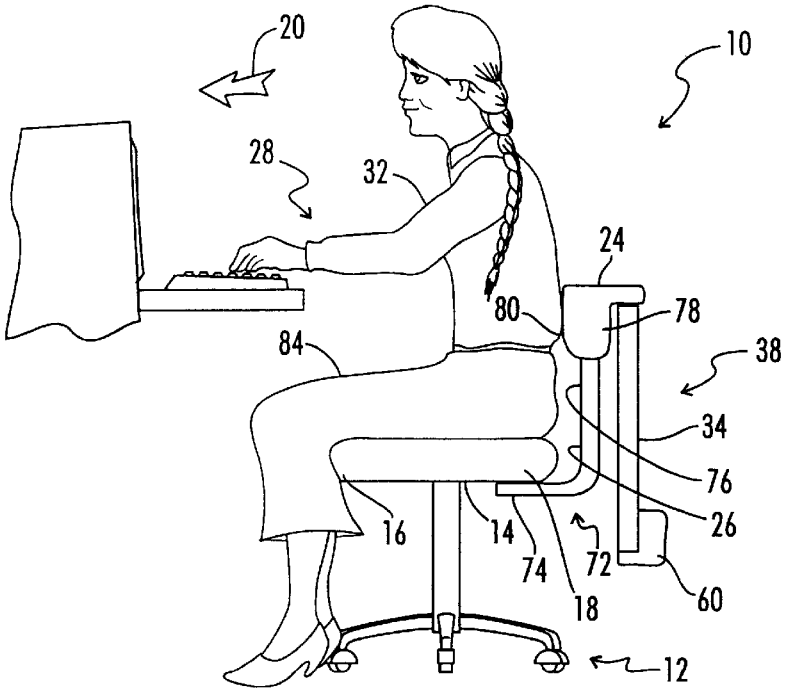
FIG. 2 shows a schematic view of the chair being used in a first mode of operation with the table in a stowed position.
Figure 3:
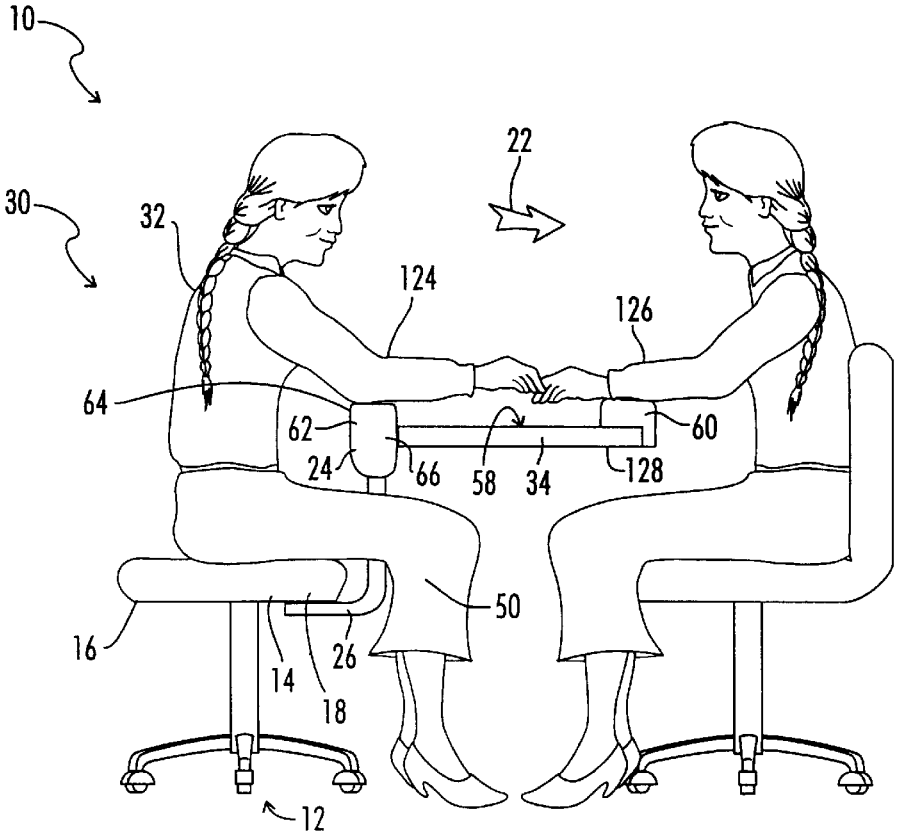
FIG. 3 depicts the present invention in the form of a portable manicurist's table being used in a second mode of operation.

FIG. 1 shows one embodiment of the present invention referred to as a chair and designated generally as 10. The chair 10 in FIG. 1 includes a base 12 and a seat 14 supported by the base 12. The seat 14 has a seat front 16 and a seat back 18, wherein the seat front 16 and the seat back 18 define a forward direction 20 as referenced by the seat back 18 toward the seat front 16, and a rearward direction 22 as referenced from the seat front 16 toward the seat back 18. The chair 10 includes a backrest 24 and backrest support 26 for supporting the back rest 24 in a position relative to the seat 14 which allows the seat 14 to be utilized in a first mode of operation 28, and a second mode of operation 30. FIG. 2 shows the chair 10 being used in the first mode of operation 28; and FIG. 3 shows the chair 10 being used in the second mode of operation 30.

The first mode of operation 28, shown in FIG. 2, includes an occupant 32 sitting on the seat 14 facing forward 20. The second mode of operation 30, shown in FIG. 3, includes an occupant 32 sitting on the seat 14 facing rearward 22. Referring to FIG. 1, the backrest support means 26 is being supported by the base 12, and is connected to the backrest 24.

The chair 10 also includes a stowable table 34, and table support means 36 for supporting the stowable table 34 in a stowed position 38, see FIG. 2, and an upright position 40, see FIG. 1. In the upright position 40, the stowable table 34 extends rearward 22 from a position 42 near the backrest, see FIG. 1, in a generally horizontal orientation. In the stowed position 38, the stowable table extends downward in a substantially vertical orientation, see FIG. 2. The table support means 36 is typically connected to the backrest 24 and the stowable table 34.

Figure 10:
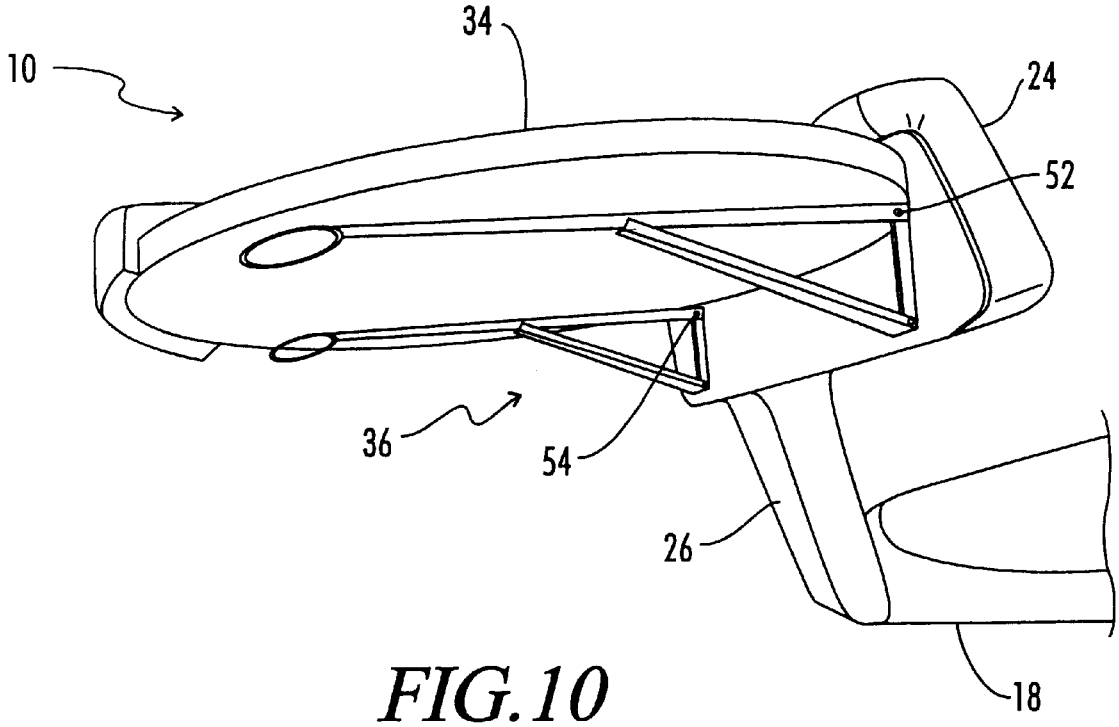
FIG. 10 shows a partial perspective view of one embodiment of the chair-table combination. One embodiment of the hinge is shown supporting the stowable table.
Figure 11:
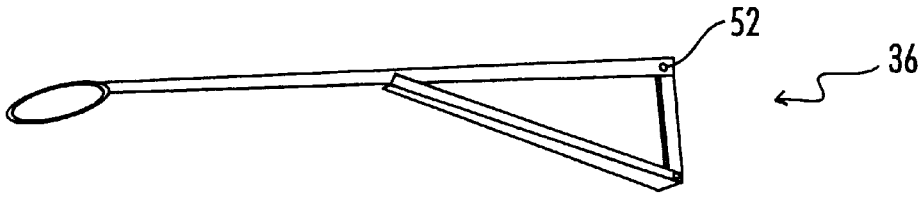
FIG. 11 shows one embodiment of the table support means shown in FIG. 10.

FIG. 10 shows one embodiment of the table support means 36. In FIG. 10 a partial perspective view of the back side of the chair 10 is shown. The backrest support means 26 extends upward from the seat back 18. The backrest 24 is supported on the backrest support means 26. The table support means connects the table 34 to the backrest 24. In the embodiment shown, the table support means 36 includes a first hinge 52 and a second hinge 54. FIG. 11 shows an unattached perspective view of the table support means 36. Other support means will be apparent to those of skill in the art from teachings disclosed herein and conventional equivalents.

Figure 4:
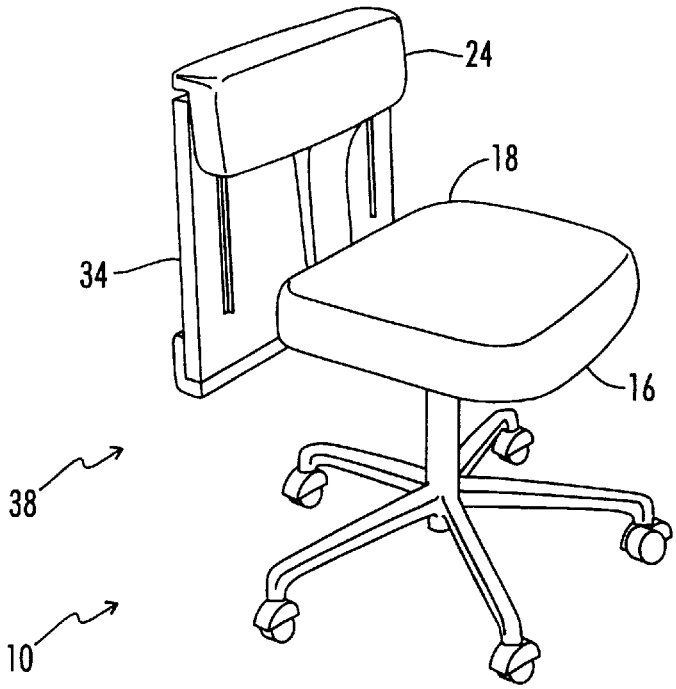
FIG. 4 shows a front perspective view of the present invention in a stowed position.
Figure 5:
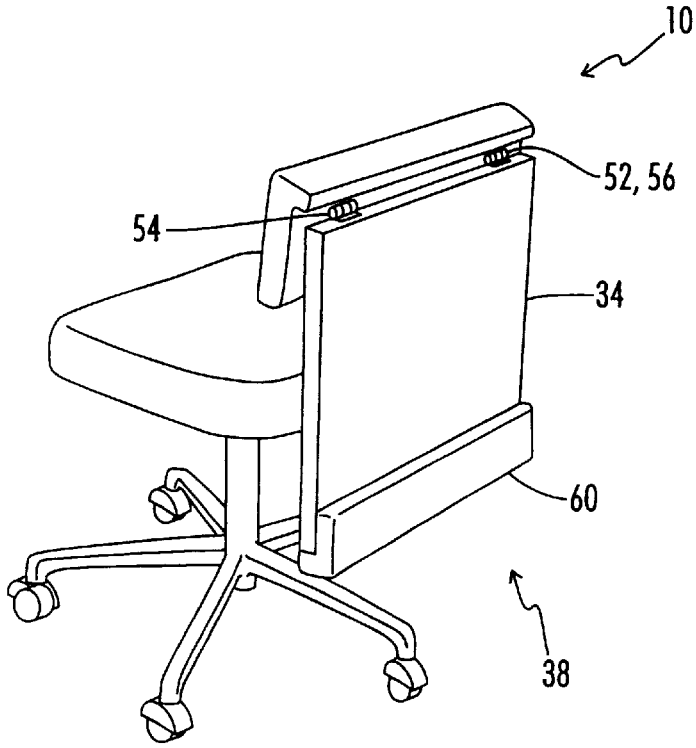
FIG. 5 shows the invention shown in FIG. 4 rotated 180°.

FIG. 4 shows a perspective view of the chair 10 with the stowable table 34 in a stowed position 38. FIG. 5 shows the chair 10 shown in FIG. 4 rotated 180 degrees.

In one embodiment of the chair 10, the backrest support means 26 comprises a central support post 44 connected to the backrest 24 and the base 12. The backrest 24, the central post 44, and the seat 14 define a left leg opening 46 and a right leg opening 48. This allows an occupant 32 to utilize the seat 14 in the second mode of operation 30 by positioning a left leg (not shown) in the left leg opening 46 and a right leg 50 in the right leg opening 48. See FIGS. 1 and 3.

Generally, the backrest 24 is vertically adjustable relative to the seat 14. This may be accomplished by any conventional means including pneumatic adjustments turnbuckle adjustments and single screw connections.

Referring to FIG. 5, an embodiment of the chair 10, wherein the table support means 36 comprises a hinge 52 is shown. FIG. 5 also shows a second hinge 54. The hinge 52, and typically the second hinge 54, connects the stowable table 34 to the backrest 24. This allows the stowable table 34 to be swung between the stowed position 38, see FIGS. 4 and 5, and the upright position 40, see FIGS. 1 and 3. Generally, the hinge 52 is a horizontal hinge connected to the backrest 24. Typically it extends substantially the length of the backrest 24. Although, as shown in FIG. 10, the table support means 36 may comprise a pair of brackets, each having at least one hinge.

In FIGS. 2, 4, and 5 the stowable table 34 extends in a substantially vertical downward orientation from the horizontal hinge connected to the backrest 24 when the stowable table 34 is in the stowed position 38. It will be apparent, however, to those of skill in the art that the stowed position need not be extending substantially vertically downward.

Generally, the stowable table 34 extends perpendicularly from the backrest 24 when the stowable table 34 is in the upright position 38. This is shown well in FIGS. 6 and 3. More generally, however, the stowable table 34 extends horizontally from the backrest 24 when the stowable table 34 is in the upright position 38. This is shown in FIG. 7 in which the table top 34 is inclined relative to a perpendicular line.

In the embodiments of the present invention depicted in FIGS. 1 and 3, the stowable table top 34 comprises a top surface 58. The top surface 58 includes a wrist pad 60.

Figure 6:
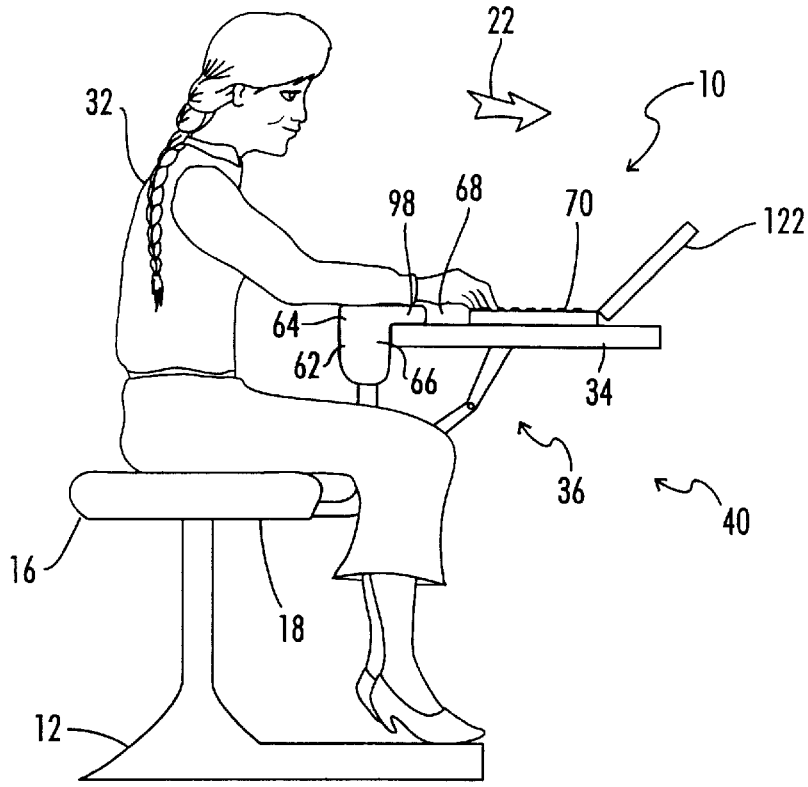
FIG. 6 shows the present invention being utilized as a portable work station in a second mode of operation.
Figure 7:
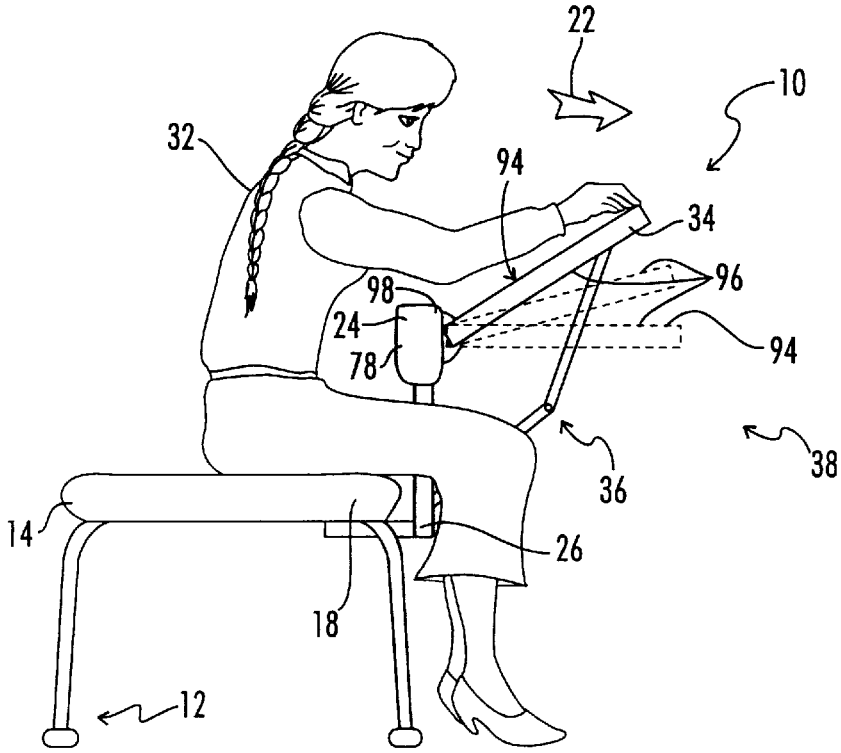
FIG. 7 more clearly shows the table surface being adjustable relative to a horizontal position. Broken lines indicate other positions.

FIGS. 3 and 6 show an embodiment of the chair 10 wherein the backrest 24 comprises a top portion includes a wrist pad 64. While variations will be apparent to those of skill in the art the stowable table 34 shown in FIGS. 3 and 6 extend from a location 66 below the backrest 24 top portion 62. In one preferred embodiment the location 66 from which the table 34 extends spaced an optimal distance 68 below the wrist pad 64 for utilizing a keyboard 70 lying on the stowable table 34 top surface 58.

Thus, it will be apparent to those of skill in the art that the present invention may also be referred to as a mobile work station because it is more than just a "chair." In one embodiment the mobile work station 10 comprises a base 12; a seat 14 having a front 16 and a back 18 and a defining corresponding forward 20 and backward 22 directions respectively.

The backrest support means 26 may also be a vertical support member 72 having a lower portion 74, an upper portion 76, and a horizontal support member 78 attached to the upper portion 76. The vertical support member 72 is attached to the base 12 near the seat back 16 to position the horizontal support member 78 at a lower back support height 80. The vertical support member 72 is also attached to the base to define a first leg opening 82 between the horizontal support member 78 and the seat 14. The first leg opening 82 is sufficiently large to accommodate a leg 84 of a user (or occupant) 32 seated on the seat 14 facing backward 22. The lower back support height 80 corresponding to a height at which the horizontal support member 78 is positioned to provide lower back support to a user 32 seated on the seat facing forward. See FIGS. 8 and 2. The mobile work station 10 also includes a work surface 86 having a first edge 88, a second edge 90 and a top surface 92. The first edge 88 is attached to the horizontal support member 78 and the work surface 86 extends from the horizontal support member 78.

Typically the work surface 86 first edge 88 is hingedly attached to the horizontal support member 78. The work surface 86 is movable between a first position 94 corresponding to a generally horizontal orientation (See FIG. 8) and a down position 38 corresponding to a substantially downwardly vertical position (See FIG. 2). In some embodiments the work surface 86 is adjustable among a plurality of up orientations 96 including the first up position 94. See FIG. 7. In FIG. 7 broken lines indicate the plurality of movable or adjustable locations.

In some embodiments the horizontal support member 78 comprises a lip 98 above the first edge 88 of the work surface 86 when the work surface 86 is in one of the up positions 96. See FIG. 7. Comparing FIG. 8 with FIG. 7, the lip 98 shown in FIG. 8 extends over the first edge 88 of the work surface 86. Typically the horizontal member 78 comprises padding 100 over the lip 98. See FIG. 8. In the embodiment shown in FIG. 8 the work surface 86 comprises a pad 102 located on the top surface 92 near the second edge 90.

Figure 9:
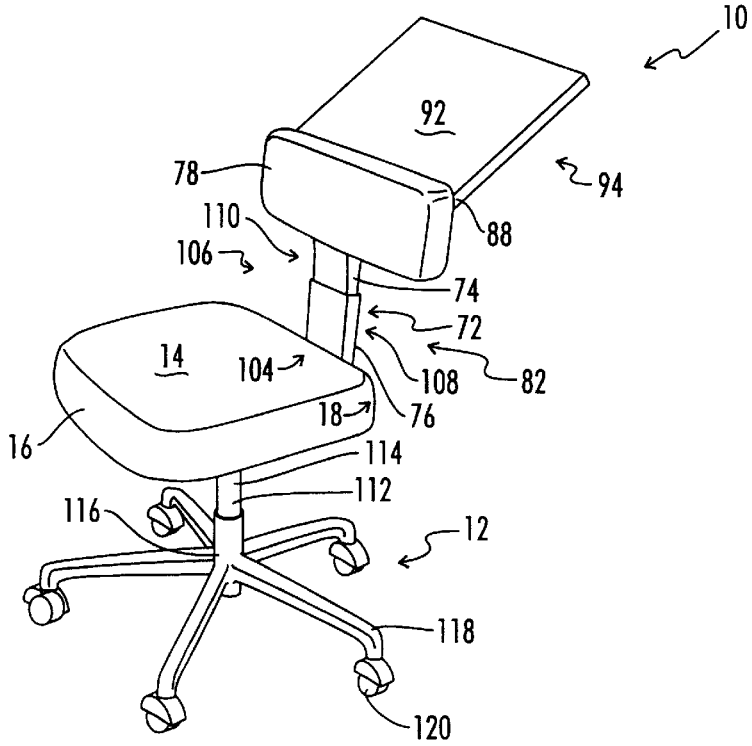
FIG. 9 depicts another embodiment of the invention showing an adjustable base center post and adjustable rear center posts.

Referring to FIG. 9 the seat back 18 has a center portion 104. In some embodiments the vertical support member 72, the horizontal support member 78, and the seat 14 define a second leg opening 106 wherein the first leg opening 82 is on a first side 108 of the vertical support member 72 and the second leg opening 106 is on a second side 110 of the vertical support member. And, as previously stated, typically the work surface 86 first edge 80 is hingedly attached to the horizontal support member 78, wherein the work surface 86 is movable between a first up position 94 corresponding to a generally horizontal position and a down position 38. Though typical, other conventional attachments will be apparent to those of skill in the art, including slotted or pinned attachments.

Figure 8:
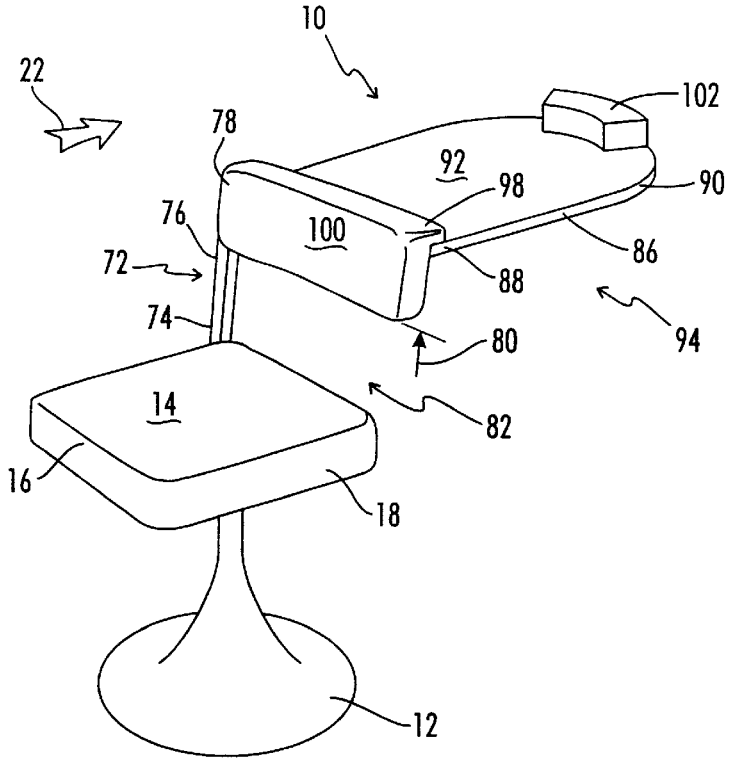
FIG. 8 shows a perspective view of another embodiment of the present invention wherein a leg opening will accommodate both legs and a side post is used to support the backrest rather than a center post.

FIG. 8 depicts the work surface 86 comprising an elongated pad 102 at the second edge 90.

In one embodiment the base 12 comprises a vertically adjustable center post 112 having a first end 114 attached to the seat 14 and a second end 116 opposite the first end 114. The base 12 also comprises a plurality of legs 118 extending from the second end 116, wherein each leg 118 includes a caster 120. See FIG. 9. In some embodiments the horizontal support member 78 is vertically adjustable relative the seat. This will allow the user to adjust the work station to accommodate a variety of user heights. For instance in one embodiment the first leg opening 82 and the lower back support height 80 are respectively sized and proportioned to accommodate a user 32 having a height between 4' and 5'5". In another embodiment the first leg opening 82 and the lower back support height 80 are respectively sized and proportioned to accommodate a user having a height between 5'5" and 6'2". Other standard or adjustable height sizes and proportions will be apparent to those of skill in the art.

In one preferred embodiment the work surface 86 top surface 92 has a size and shape sufficient to accommodate a portable electronic device 122. See FIG. 6. Such devices typically include laptop computers and the like. Although, other conventional devices and sizes and shapes will be apparent to those of skill in the art and adjustable for specific functions.

In one embodiment the size and shape sufficient to accommodate a portable electronic storage device 122 is sufficient to accommodate a laptop computer, shown as 122 in FIG. 6, having a footprint measuring at least 8 inches square.

Referring to FIG. 8, the second edge 90 of the work surface 86 maybe curved and include a curved pad 102 attached thereon. In the embodiment shown in FIG. 8, the curved pad 102 is also an elongated pad. In other embodiments the pad extends substantially the width of the second edge. As shown in FIG. 3, preferably the pad 60 is of a sufficient height and comfort for a user receiving a manicure to rest her arms or wrists upon.

It will be apparent to those of skill in the art that the present invention includes other objects and advantages than those specifically described, including other methods. For example the present invention includes a method of setting up and utilizing a work station 10 comprising the steps of providing a base 12; supporting a seat 14 having a front 16 and a back 18 on the base 12; attaching a generally planar surface 92 to a horizontal support member 78 and supporting the horizontal support member 78 with a vertical support member 72 attached to the base 12 and proximate the seat back 18. The method also includes aligning the vertical support member 72 with a central portion 104 of the seat back 18; orienting the generally planar surface 92 at an optimal work angle relative a horizontal plane (See FIG. 7); sitting on the seat; and straddling the vertical support member.

Referring to FIG. 3, the method may include supporting a manicurist's forearm 124 and a first pad 64 near the horizontal support member 24; and supporting a client's forearm 126 on a second pad 60 near an end 128 of the generally planar surface 34 (also shown in planar surface 92 in FIG. 9). FIG. 7 depicts a step of orienting the generally planar surface 94 comprising a step of tilting the planar surface up relative to the horizontal plane. The invention also includes the step of swinging the planar surface 34 into a stowed position. See FIG. 2. The method may further include the step of supporting a work piece on the planar surface with a lip near the horizontal support member. In FIG. 6 the work piece is depicted as an electronic device 122. Referring to FIG. 7 when the planar surface is tilted up, the lip 98 will prevent a work piece from sliding off the surface. The invention may also include the step of looking toward the planar surface as shown in FIG. 7 and FIG. 8.

This will allow the planar surface to in some embodiments protect the user from hazardous material beneath the planar surface. This would be particularly useful when the planar surface is transparent. The planar surface may also be used to support textural or graphical work, which is easier to read in a tilted position, as is shown in FIG. 7. In FIG. 3 the work surface is used to support a client's hands in a convenient location for the manicurist to comfortably work on the client's hands.

FIG. 6 shows the application of the method wherein the steps include placing a keyboard 70 on the planar surface 34 and padding the lip wherein the lip 98 is integral with the horizontal support member 66. Preferably the method includes the step of orienting the planar surface into an optimal work angle and locking the planar surface into the optimal work angle.

Thus, although there have been described particular embodiments of the present invention of a new and useful Chair-Table Combination, it is not intended that such references be construed as limitations upon the scope of this invention except as set forth in the following claims.

What is claimed is:

1. A chair comprising:

a base;

a seat supported by the base and having a seat front and a seat back, wherein the seat front and the seat back define a forward direction as referenced from the seat back toward the seat front and a rearward direction as referenced from the seat front toward the seat back;

a backrest;

backrest support means for supporting the backrest in a position relative to the seat which allows the seat to be utilized in a first mode of operation and a second mode of operation, wherein the first mode of operation includes an occupant sitting on the seat facing forward, and wherein the second mode of operation includes an occupant sitting on the seat facing rearward, the backrest support means being supported by the base and connected to the backrest;

a stowable table; and table support means including a pivotal axis, for supporting the stowable table in a stowed position and in an upright position, wherein in the upright position the stowable table extends rearward from a position near the backrest in a generally horizontal orientation, and in the stowed position the stowable table extends downward from the pivotal axis in a substantially vertical orientation, the table support means being connected to the backrest and the stowable table.

2. The chair of claim 1, wherein the backrest support means comprises a central support post connected to the backrest and the base, wherein the backrest, the central support post, and the seat define a left leg opening and a right leg opening, whereby an occupant may utilize the seat in the second mode of operation by positioning a left leg in the left leg opening and a right leg in the right leg opening.

3. The chair of claim 2, wherein the backrest is vertically adjustable relative to the seat.

4. The chair of claim 1, wherein the table support means comprises a hinge connecting the stowable table to the backrest, whereby the stowable table may be swung between the stowed position to the upright position.

5. The chair of claim 4, wherein the hinge is a horizontal hinge connected to the backrest.

6. The chair of claim 5, wherein the stowable table extends in a substantially vertical downward orientation from the horizontal hinge connected to the backrest when the stowable table is in the stowed position.

7. The chair of claim 1, wherein the stowable table extends horizontally from the backrest when the stowable table is in the upright position.

8. The chair of claim 7, wherein the stowable table extends perpendicularly from the backrest when the stowable table is in the upright position.

9. The chair of claim 1, wherein the stowable table comprises a top surface, the top surface including a wrist pad.

10. The chair of claim 1, wherein the backrest comprises a top portion, the top portion including a wrist pad.

11. The chair of claim 10, wherein the stowable table extends from a location below the backrest top portion wrist pad.

12. The chair of claim 11, wherein the location from which the table extends is spaced an optimal distance below the wrist pad for utilizing a keyboard lying on the stowable table top surface.

13. A mobile work station comprising:

a base;

a seat having a front and a back and defining corresponding forward and backward directions, respectively;

a vertical support member having an upper portion, a lower portion, and a horizontal support member attached to the upper portion, wherein the vertical support member is attached to the base near the seat back to position the horizontal support member at a lower back support height and to define a first leg opening between the horizontal support member and the seat, the first leg opening being sufficiently large to accommodate a leg of a user seated on the seat facing backward and the lower back support height corresponding to a height at which the horizontal support member is positioned to provide lower back support for a user seated on the seat facing forward; and a work surface having a first edge, a second edge and a top surface, the first edge being attached to the horizontal support member and the work surface extending from the horizontal support member.

14. The apparatus of claim 13, wherein the work surface first edge is hingedly attached to the horizontal support member, and the work surface is movable between a first up position corresponding a generally horizontal orientation and a down position corresponding to a substantially downwardly vertical position.

15. The apparatus of claim 14, wherein the work surface is adjustable among a plurality of up orientations, including the first up position.

16. The apparatus of claim 14, wherein the horizontal support member comprises a lip extending above the first edge of the work surface when the work surface is in one of the up positions.

17. The apparatus of claim 16, wherein:

the lip extends over the first edge of the work surface; and the horizontal support member comprises padding over the lip.

18. The apparatus of claim 17, wherein the work surface comprises a pad located on the top surface near the second edge.

19. The apparatus of claim 13, wherein:

the seat back comprises a center portion;

the vertical support member is attached to the base near the center portion of the seat back;

the vertical support member, the horizontal support member, and the seat define a second leg opening wherein the first leg opening is on a first side of the vertical support member and the second leg opening is on a second side of the vertical support member; and the work surface first edge is hingedly attached to the horizontal support member, wherein the work surface is movable between a first up position corresponding to a generally horizontal position and a down position corresponding to a substantially downwardly vertical position.

20. The apparatus of claim 19, wherein the horizontal support member comprises a padded lip extending over the first edge of the work surface when work surface is in the first up position.

21. The apparatus of claim 19, wherein the work surface comprises an elongated pad at the second edge.

22. The apparatus of claim 19, wherein the base comprises:

a vertically adjustable center post having a first end attached to the seat, and a second end opposite the first end; and a plurality of legs extending from the second end, each of the legs including a caster.

23. The apparatus of claim 19, wherein the horizontal support member is vertically adjustable relative to the seat.

24. The apparatus of claim 13, wherein the first leg opening and the lower back support height are respectively sized and proportioned to accommodate a user having a height between four feet and five feet, five inches.

25. The apparatus of claim 13, wherein the first leg opening and the lower back support height are respectively sized and proportioned to accommodate a user having a height between five feet and six feet, two inches.

26. The apparatus of claim 13, wherein the work surface top surface has a size and shape sufficient to accommodate a portable electronic storage device.

27. The apparatus of claim 26, wherein the size and shape sufficient to accommodate a portable electronic storage device is sufficient to accommodate a lap-top computer having a footprint measuring at least eight inches square.

28. The apparatus of claim 13, wherein the second edge of the work surface is curved and includes a curved pad attached thereon.

* * * * *